United States Patent [19]

Hagenbach et al.

[11] 4,223,085

[45] Sep. 16, 1980

[54] SEMI-CONDUCTIVE NICKEL CARRIER PARTICLES

[75] Inventors: Robert J. Hagenbach, Rochester; Rudolph Forgensi, Webster; Stewart W. Volkers, Williamson; Dennis F. Di Orazio, Webster, all of N.Y.

[73] Assignee: Xerox Corporation, Stamford, Conn.

[21] Appl. No.: 673,320

[22] Filed: Apr. 5, 1976

[51] Int. Cl.[2] ..... G03G 9/14; G03G 9/10

[52] U.S. Cl. ..... 430/108; 148/6.35; 148/105; 427/216; 428/403

[58] Field of Search ..... 427/18, 216; 252/62.1 P, 62.55; 148/6.35, 105; 428/403

[56] References Cited

U.S. PATENT DOCUMENTS

| | | | |
|---|---|---|---|
| 3,632,512 | 1/1972 | Miller | 252/62.1 |
| 3,679,398 | 7/1972 | Geus | 148/105 X |
| 3,767,477 | 10/1973 | McCabe et al. | 148/6.35 |
| 3,767,578 | 10/1973 | Hagenbach et al. | 96/15 D X |
| 3,849,182 | 11/1974 | Hagenbach | 252/62.1 P X |
| 4,018,601 | 11/1971 | Hagenbach | 427/18 X |

*Primary Examiner*—Roland E. Martin, Jr.
*Assistant Examiner*—Stuart D. Frenkel

[57] ABSTRACT

Magnetically-responsive electrostatographic nickel carrier particles having semi-conductive and lower triboelectric charging properties are prepared by heat treating nickel particles in an ambient atmosphere as to provide the carrier particles with an oxide coating. More particularly, commercially available nickel particles are placed in a furnace and the particles are heat treated at a temperature of between about 600° C. and about 1,000° C. for a period of time of between about 5 and 10 minutes. When employed with finely-divided toner particles to develop electrostatic latent images in a magnetic-brush development apparatus, the treated carriers have been found to alleviate shorting problems and to provide developed images having lower background densities and higher resolution than prior carrier materials.

12 Claims, No Drawings

SEMI-CONDUCTIVE NICKEL CARRIER PARTICLES

BACKGROUND OF THE INVENTION

This invention relates in general to electrophotography and more particularly, to a process for preparing carrier materials useful in the magnetic-brush type development of electrostatic latent images.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light and shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,522 is known as "cascade" development. In this method, a developer material comprising relatively large carrier particles having finely-divided toner particles electrostatically clinging to the surface of the carrier particles is conveyed to and rolled or cascaded across the electrostatic latent image-bearing surface. The composition of the toner particles is so chosen as to have a triboelectric polarity opposite that of carrier particles. As the mixture cascades or rolls across the image-bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S. Pat. 3,099,943.

Another technique for developing electrostatic latent images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic-image bearing surface and the toner particles are drawn from the brush to the electrostatic image by electrostatic attraction.

In automatic reproduction equipment, it is conventional to employ as the imaging plate, a photoconductor on a conductive substrate in the form of a cylindrical drum or a flexible belt which is continuously rotated through a cycle of sequential operations including charging, exposing, developing, transferring and cleaning. The developer chamber is charged with a developer mixture comprising carrier particles and enough toner for hundreds of reproduction cycles. Generally, the freshly charged developer mixtures contain between about 0.5 and 5 percent toner based upon the weight of the developer. This initial concentration provides sufficient toner for many reproduction cycles without causing undesirably high background toner deposition.

The imaging plate is usually given a uniform positive charge by means of a corona generating device connected to a suitable source of high potential as disclosed by L. E. Walkup in U.S. Pat. No. 2,777,957. The plate is then discharged in imagewise configuration by exposure to a light image corresponding to the original to be copied. The resultant latent image is then brought into developing configuration with the developer mixture. The relatively high electric field over the imaged areas of the plate attracts the toner powder from the carrier particles whereas, ideally, the unimaged areas of the plate, do not. Optimally the charged pattern on the imaged plate corresponds to the light and dark areas of the original. However, as explained in "Xerography and Related Processes", Dessauer and Clark, The Focal Press, New York (1965), development fields of dark imaged areas which are very large compared with the thickness of the photoconductive film are confined to the edges of the images. In order to overcome this undesirable effect, a conductive surface called a "development electrode" is placed near the metal substrate of the imaging plate either with or without bias potential, to increase the electric field above the large uniformly charged areas to aid in solid area development and reduce background development. When such electrodes are biased, as they usually are in commercially available machines, a field is created between the plate and the electrode which accurately represents the charge density of the latent image. Ideally, such an electrode should be held in virtual contact with the imaging plate since both development and background suppression fields are increased with decreasing distance between the electrode and plate. However, it is not practical to have the development electrode in virtual contact with the plate in development processes employing developer mixtures with solid carrier particles After development the image is transferred to a copy support surface, such as paper, by electrostatically charging the paper to cause it to attract the developed image. After image transfer, the residual toner and carrier particles are removed before the plate is reused in subsequent cycles. This is generally accomplished by imparting an opposite charge to the photoconductive surface thereby nullifying any electrostatic attraction between the surface and the particles, then rubbing the surface to physically remove all the remaining particles and exposing it to light to fully discharge the surface.

It is known to employ both coated and uncoated carrier beads to prepare developer mixtures. However, carrier beads coated with a polymer are subject to deterioration when the coating separates from the carrier core as the carrier particles are repeatedly impacted and abraded against machine parts and other carrier particles. The separated coatings form chips and flakes which cause print deletion and poor quality; and fines and grit which tend to drift and form unwanted deposits on critical machine parts. In addition, of course, the triboelectric properties of the carrier material vary with deterioration of the coating, resulting in inefficient carrier performance.

Therefore, recent efforts have been directed toward the provision of uncoated carrier particles which have triboelectric and other physical properties rendering them suitable for developer use. A useful uncoated carrier material is disclosed in U.S. Pat. No. 3,767,578 by Robert J. Hagenbach and Myron J. Lenhard. This patent describes carrier beads characterized by a pebbled surface with recurring recesses and protrusions giving particles a relatively large external surface area and providing excellent properties for electrostatographic use. Among the "nodular" particles disclosed in the Hagenbach and Lenhard patent are nodular nickel and nodular steel. Generally, the uncoated carrier materials which are suitable for use in conjunction with commonly employed photoconductors such as selenium, must be metal, because of density and triboelectric requirements. Other uncoated carrier beads can be used with success to develop conventionally used photoconductive surfaces. For example, zinc carrier beads can be used in the development process disclosed in U.S. Pat. No. 3,503,776 to develop an imaged selenium photoconductive surface.

Though developer compositions comprising uncoated carrier beads have been found to initially produce prints of excellent quality, it has been observed that as toner is depleted from the developer mixture and toner concentration approaches low permisible levels, background development increases and print quality is reduced. This problem is especially prominent in copying machines employing magnetic brush development techniques in which the magnetic roll has a bias potential to make the roll perform as a development electrode. This problem is particularly severe with uncoated metal carrier beads.

In view of the ascending importance of uncoated carrier beads because of the good print quality they are potentially capable of producing and the limitations which developer mixtures containing uncoated carrier beads presently have, it is an object of the present invention to provide a developer composition having the advantages, but not the disadvantages, attached to those employing uncoated carrier beads.

It is a further object of the present invention to provide a developer mixture which is much less sensitive to low toner concentration than previously known developer mixtures containing uncoated carrier beads.

It is a further object of this invention to provide a method for preparing electrostatographic carrier materials which overcome the above noted deficiencies.

It is a further object of this invention to provide a process for preparing magnetically responsive carrier particles having a homogeneous surface.

It is another object of this invention to provide a process for preparing magnetically-responsive carrier particles which have semi-conductive properties.

It is a further object of this invention to provide electrostatographic carrier materials which exhibit lower triboelectric charging properties.

A further object of this invention is to provide improved developer compositions for use in magnetic brush development.

It is another object of this invention to provide developer materials having physical and electrical properties superior to those of known developer materials.

The above objects and others are accomplished in accordance with this invention, generally speaking, by the application of an oxide coating to the surface of nickel carrier particles. It has been found that the application of a proper oxide coating to electrostatographic nickel carrier particles reduces the conductivity of the carrier particles and also reduces the triboelectric charging values of developer mixtures made therewith thereby providing optimum electrostatographic properties to a magnetic brush development system. More specifically, in accordance with this invention, nickel carrier particles are exposed to oxidation in an ambient atmosphere at a temperature of between about 600° C. and up to about 1,000° C. for between about 5 minutes and up to about 10 minutes. Nickel carrier particles treated in accordance with this invention are found to possess a surface oxide layer which is highly desirable with respect to their use in magnetic brush development electrostatographic copying and duplicating devices. When employed with finely-divided toner particles to develop electrostatic latent images in a magnetic-brush development apparatus, the nickel carrier particles of this invention have been found to provide developed images having lower background densities and higher resolution than prior carrier materials. Although not wishing to be bound by any theory, it is believed that the improved results obtained are due to the semi-conductive properties of the carrier materials prepared by the process of this invention. Untreated nickel carrier particles when employed in developer mixtures at low toner concentrations had been found to perform unsatisfactorily in that they provide a high conductivity and create shorting problems in a magnetic-brush development copying and/or duplicating device. For the purposes of this invention, the treated nickel carrier particles are considered to possess semi-conductive properties when the surface thereof has a volume resistivity of between about $10^6$ ohm-cm at about 300 volts and up to about $10^8$ ohm-cm at about 1,000 volts. However, it is preferred that the surface of the treated nickel carrier particles have a volume resisitivity of about $10^8$ ohm-cm.

The carrier materials which are suitable for treatment in accordance with this invention include ferromagnetic nickel powder in various forms. Thus, a wide variety of particulate, magnetically-responsive nickel materials the surface of which can be oxidized including materials in such forms as particles produced by atomization of molten metal and subsequent cooling of the droplets; particles produced by direct chemical reduction or hydrometallurgical processes; particles produced by grinding, milling, filing, turning, etc.; as well as particles of nickel alloys having oxidizable nickel on the surface thereof such as stainless steel containing nickel and cobalt may be treated in accordance with this invention. The treated ferromagnetic carrier particles may vary in size and shape with useful results being obtained with average particle sizes of from about 30 microns to about 1,000 microns. Particularly useful results are obtained with average particle sizes from about 50 microns to about 500 microns. The size of the carrier particles employed will, of course, depend upon several factors, such as the type of images ultimately developed, the machine configuration, and so fourth. Treated nickel carrier particles having a pebbled surface with recurring recesses and protrusions and particularly preferred because they have a greater toner carrying capacity than those having a smooth surface.

In accordance with this invention, semi-conductive magnetically-responsive carrier particles having satisfactory electrostatographic properties may be obtained by heat treating nickel particles in an ambient atmosphere at a temperature of between about 600° C. and about 1,000° C. for between about 5 and 10 minutes. Optimum results are obtained when the carrier particles of this invention are heat treated in an ambient atmosphere at a temperature of about 1,000° C. for about 10 minutes.

Any suitable type of furnace may be employed to heat treat the treated nickel carrier particles of this invention. Typical furnaces include a static furnace, a rotary kiln, a tunnel kiln, or an agitated bed furnace. The static furnace type will generally provide for long residence times, while the rotary kiln and agitated bed type of furnace generally provide more uniform product reaction, consistent residence time, and high capacity throughput. During the treatment of the carrier particles as described, it is highly desirable to agitate the particles at least occasionally, so as to completely expose the surfaces of the particles for more uniform treatment thereof. In any event, a furnace providing a controlled heat treating temperature and controlled atmosphere profile provides a more controlled method of preparing the carrier particles.

The oxide coating produced upon the treated nickel carrier particles of this invention may be any suitable thickness or weight percent. However, an oxide coating having a thickness at least sufficient to form a thin continuous film on a carrier substrate is preferred because the oxide coating will then possess sufficient thickness to resist abrasion and prevent pinholes which adversely affect the triboelectric properties of the carrier particles. Generally, the oxide coating may comprise from about 0.4 percent to about 4.0 percent by weight based on the weight of the oxide coated carrier particles. Preferably, the oxide coating should comprise from about 3 percent to about 4 percent by weight based on the weight of the oxide coated carrier particles because maximum durability, triboelectric response, and copy quality are achieved.

Any suitable well known toner material may be employed with the treated nickel carriers of this invention. Typical toner materials include gum copal, gum sandarac, rosin, cumaroneindene resin, asphaltum, gilsonite, phenolformaldehyde resins, rosin modified phenolformaldehyde resins, methacrylic resins, polystyrene resins, polypropylene resins, epoxy resins, polyethylene resins, polyester resins, and mixtures thereof. The particular toner material to be employed obviously depends upon the separation of the toner particles from the oxide coated carrier in the triboelectric series and should be sufficient to cause the toner particles be electrostatically cling to the carrier surface. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. 25,136 to Carlson and U.S. Pat. No. 2,788,288 to Rheinfrank et al. These toners generally have an average particle diameter between about 1 and 30 microns.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Green Ozalate, lampblack, Rose Bengal, Monastral Red, Sudan Black BM, and mixtures thereof. The pigment or dye should be present in a quantity sufficient to render it highly colored so that it will form a clearly visible image on a recording member. Preferably, the pigment is employed in an amount from about 3 percent to about 20 percent by weight based on the total weight of the colored toner because high quality images are obtained. If the toner colorant employed is a dye, substantially smaller quantities of colorant may be used.

Any suitable conventional toner concentration may be employed with the oxide coated nickel carriers of this invention. Typical toner concentrations for development systems include about 1 part toner with about 10 to about 200 parts by weight of carrier.

The carrier materials of the instant invention may be mixed with finely-divided toner particles and employed to develop electrostatic latent images on any suitable electrostatic latent image-bearing surface including conventional photoconductive surfaces. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium tri-sulfide, gallium selenide arsenic disulfide, arsenic trisulfide, arsenic triselenide, antimony trisulfide, cadmium sulfoselenide, and mixtures thereof. Typical organic photoconductors include: quinacridone pigments, pthalocyanine pigments, triphenylamine, 2,4-bis(4,5'-diethylaminophenol)-1,3,4-oxidiazol, N-isopropylcarbazole, triphenylpyrrole, 4,5-diphenylimidazolidinone, 4,5-diphenylimidazolidinethione, 4,5-bis-(4'aminophenyl)-imidazolidinone, 1,5-dicyanonaphthalene, 1,4-dicyanonaphthalene, aminophthalocinitrile, nitrophthalodinitrile, 1,2,5,6-tetra-azacyclooctatetraene-(2,4,6,8), 2-mercaptobenzothiazole-2-phenyl-4-diphenylidene-oxazolone, 6-hydroxy-2,3-di(p-methoxyphenyl)-benzofurane, 4-dimethylaminobenzylidene-benzhydrazide, 3-benzylidene-aminocarbazole, polyvinyl carbazole, (2-nitrobenzylidene)-p-bromoaniline, 2,4-diphenyl-quinazoline, 1,2,4-triazine, 1,5-diphenyl-3-methyl-pyrazoline, 2-(4'-dimethylamino phenyl)-benzoxazole, 3-amine-carbazole, and mixtures thereof. Representative patents in which photoconductive materials are disclosed include U.S. Pat. No. 2,803,542 to Ullrich, U.S. Pat. No. 3,121,007 to Middleton, and U.S. Pat. No. 3,151,982 to Corrsin.

The oxide coated nickel carrier materials produced by the process of this invention provide numerous advantages when employed to develop electrostatic latent images. For example, when mixed with an appropriate toner material, the resultant developer composition enhances development with an accompanying increase in exposure latitude. Further, such developer compositions are found to provide lower background densities, higher image densities and greatly improved overall print qualities.

Developer mixtures of the present invention are particularly useful in reproduction systems employing a development electrode and magnetic brush development rolls. In practical use, magnetic rolls with a bias potential perform the function of both the magnetic brush and the development electrode. In a typical situation in which a selenium photoconductor is developed by a plurality of magnetic rolls bearing a developer mixture comprising between about 0.75 and 3 percent of a pigmented polymer toner (e.g. a 10 percent carbon black dispersion in a polymeric matrix comprising a blend of a styrene-n-butyl with acrylate copolymer with poly(vinyl butyral)), the photoconductor bears a positive charge of about 800 volts in dark image areas and about 100 volts in non-imaged areas. The development electrode, i.e., the magnetic brushes, is biased with a potential of about 200 volts. The spacing between the development electrode and the photoconductive surface is sufficient to prevent any shorting out between the development electrode and the plate. Generally, development electrode-photoconductive spacings of about 0.04 and 0.12 inches suffice to prevent undue damage to the photoconductive surface, while bringing the development electrode in sufficiently close proximity to the photoconductive surface. Using the semi-conductive carrier beads of the present invention, it is noted that the density of developed dark image areas is much greater with respect to background density, than when non-conductive carrier beads are used in otherwise identical conditions. It is theorized that this is due to the formation of conductive paths which effectively extend the development electrode closer to the photoconductive surface thereby effectively increasing both development and background suppression fields. This effect is absent when non-conductive carrier beads are substituted under identical operating conditions. Moreover, as the toner concentration decreases from the initial level of above about 2 percent to minimum levels for acceptable print density of about 0.5 percent of the developer mixture, this effect is hardly diminished. Likewise, developer mixtures comprising conductive nickel carrier particles, that is, untreated nickel carrier particles, produce prints of widely arranged varied quality, depending upon whether toner concentration is at the high or low end of the usable toner concentration range, and whether the photoconductive surface has any flaws through which shorting between the development electrode and the conductive backing, may occur. Under ideal conditions, the photoconductive surface is free of any imperfections; however, in operation, photoconductive surfaces frequently are scratched through frictional contact with machine parts and developer material. A fresh developer mixture containing at least about 2 percent toner and only conductive nickel carrier beads having an average particle diameter of about 100 microns, produce prints of excellent quality. However, as toner concentration decreases, the density of developed areas begins to sharply decrease while the level of background development becomes inconsistent (e.g. shorting occurs creating high background). It is theorized that this effect is due to the lengthening of conductive paths and the consequent increased chance of shorting between the development electrode and the conductive layer of the electrostatographic plate, since the toner, which is normally not conductive, acts as an insulator to interrupt conductive paths when toner concentration is sufficiently high; whereas it does not, when toner concentration decreases. Thus, in developer mixtures based upon conductive nickel carrier beads, toner concentration of a used developer mixture may be sufficiently high to produce acceptable print density under ideal conditions, but too low to prevent shorting out between the development electrode and the grounded photoconductive surface. However, the carrier materials of the present invention are capable of providing excellent print quality, i.e., high print density and low background development, over wide toner concentration ranges. Such developer mixtures are capable of developing images to an allowable minimum density without the danger of shorting between the development electrode and the conductive backing of the photoconductive surface.

In the following examples, the relative triboelectric values generated by contact of carrier beads with toner particles is measured by means of a Faraday Cage. The device comprises a stainless steel cylinder having a diameter of about one inch and a length of about one inch. A 325-mesh screen is positioned at each end of the cylinder. The cylinder is weighed, charged with about 7 grams of mixture of carrier and toner particles and connected to ground through a capacitor and an electrometer connected in parallel. Dry compressed air is then blown through the brass cylinder to drive all the toner from the carrier. The charge on the capacitor is then read on the electrometer. Next, the chamber is reweighed to determine the weight loss. The resulting data is used to calculate the toner concentration and the charge in microcoulombs per gram of toner. Since the triboelectric measurements are relative, the measurements should, for comparative purposes, be conducted under substantially identical conditions. Thus, a toner comprising a styrene-n-butyl methacrylate copolymer and carbon black as disclosed by M. A. Insalaco in U.S. Pat. No. 3,079,342 is used as a contact triboelectrification standard. Obviously, other suitable toners such as those listed above may be substituted for the toner used in the examples.

The following examples, other than the control examples, further define, describe, and compare preferred methods of preparing and utilizing the oxide coated nickel carriers of the present invention in electrostatographic applications. Parts and percentages are by weight unless otherwise indicated.

EXAMPLE I

A developer mixture is prepared by mixing two parts of toner consisting of a styrene-n-butyl methacrylate copolymer, polyvinyl butyral and carbon black, produced by the method disclosed in Example I of U.S. Pat. No. 3,079,342, having an average particle size of about 10 to about 20 microns with about 100 parts of nodular nickel particles commercially available from Sherritt Gordon Mines, Ltd. of Canada under the trade designation Grade "C" nickel powder and having a number average size of about 120 microns. The nickel particles are silver in color and have a bulk density of about 4.65 grams per cubic centimeter. The developer mixture is used to develop a selenium photoconductor carrying an electrostatic latent image by the "magnetic brush" development method described in U.S. Pat. No. 2,874,063. The magnetic field of the magnet causes alignment of the carrier and toner into a brush-like configuration. The magnetic brush is brought into developing configuration with the electrostatic image-bearing surface and toner particles are drawn from the carrier particles to the latent image by electrostatic attraction. The developer mixture is found to have a triboelectric value of about 11.4 micro-coulombs per gram of toner. The resultant images are of excellent quality up to the time at which the toner concentration falls below about 1.7 percent by weight of the developer mixture. Subsequent copy quality deteriorates rapidly as reflected by high background levels exceeding those considered acceptable, that is, up to 0.01 density. Resistivity (ohm-cm at volts) measurements on the carrier material indicated conductivity which results in shorting taking place.

EXAMPLE II

A developer mixture was prepared by mixing about two parts of toner particles as in Example I with about 100 parts of carrier particles. The carrier particles were as in Example I except that they were previously treated as follows: the carrier particles were placed in a high temperature capacity rotary furnace, (Harper Model Hou-5D34-RTA-28, available from Harper Electric Furnace Corporation, Lancaster, N.Y.) and heated to about 600° C. for about 10 minutes in an atmosphere containing about 21 percent of oxygen. After this treatment, the carrier particles were allowed to cool to ambient temperature in the furnace and examined. The treated carrier particles were found to be black in color, to have a bulk density of about 4.68 grams per cubic centimeter, and to have a 0.69 percent oxide coating. The carrier particles were mixed with toner particles and employed to develop electrostatic latent images as in Example I. The oxidized carrier developer composition was found to exhibit much better qualities than that of Example I. That is, this developer composition provided images of excellent quality even when the toner concentration fell below about 1 percent by weight of the developer mixture. All copies provided images having good resolution with very good print quality. Background densities were much lower (about 0.003) than those obtained with the developer mixture of Example I, especially at respective toner concentrations of about 1.87 percent by weight and at lower toner concentrations. The developer mixture was found to have a triboelectric value of about 5.8 micro-coulombs per gram of toner. The resistivity measurement value of the carrier material was found to be about $6.89 \times 10^6$ ohm-cm at 300 volts. It was concluded that this developer mixture represented an improvement over that of Example I.

EXAMPLE III

A developer mixture was prepared by mixing about two parts of toner particles as in Example I with about 100 parts of carrier particles. The carrier particles were as in Example I except that they were previously treated as follows: the carrier particles were placed in a furnace as in Example II and heated to between about 600° C. and about 640° C. for about 5 minutes in an atmosphere containing about 21 percent of oxygen. After this treatment, the carrier particles were allowed to cool to ambient temperature and examined. The treated carrier particles were found to be black in color, to have a bulk density of about 4.70 grams per cubic centimeter, and to have 0.46 percent oxide coating. The carrier particles were mixed with toner particles and employed to developer electrostatic latent images as in Example I. The oxidized carrier developer composition was found to exhibit much better qualities than that of Example I. That is, this developer composition provided images of excellent quality even when the toner concentration fell below about 1 percent by weight of the developer mixture. All copies provided images having good resolution with very good print quality. Background densities were much lower (about 0.003) than those obtained with the developer mixture of Example I, especially at respective toner concentrations of about 1.92 percent by weight and at lower toner concentrations. The developer mixture was found to have a triboelectric value of about 6.4 micro-coulombs per gram of toner. The resistivity measurement value on the carrier material was found to be about $6.43 \times 10^6$ ohm-cm at 300 volts. It was concluded that this developer mixture represented an improvement over that of Example I.

EXAMPLE IV

A developer mixture was prepared by mixing about two parts of toner particles as in Example I with about 100 parts of carrier particles. The carrier particles were as in Example I except that they were previously treated as follows: the carrier particles were placed in a furnace as in Example II and heated to about 1,000° C. for about 10 minutes in an atmosphere containing about 21 percent of oxygen. After this treatment, the carrier particles were allowed to cool to ambient temperature and examined. The treated carrier particles were found to be green in color, to have a bulk density of about 4.40 grams per cubic centimeter, and to have a 3.16 percent oxide coating. The carrier particles were mixed with toner particles and employed to developer electrostatic latent images as in Example I. The oxidized carrier developer composition was found to exhibit much better qualities than that of Example I. That is, this developer composition provided images of excellent quality even when the toner concentration fell below about 1 percent by weight of the developer mixture. All copies provided images having good resolution with very good print quality. Background densities were lower than those obtained with the developer mixture of Example I, especially at respective toner concentrations of about 1.77 percent by weight and at lower toner concentrations. The developer mixture was found to have a triboelectric value of about 7.5 micro-coulombs per gram of toner. The resistivity measurement value on the carrier material was found to be about $1.53 \times 10^8$ ohm-cm at 1,000 volts. It was concluded that this developer mixture represented an improvement over that of Example I.

Although specific materials and conditions were set forth in the above examples for making and using the developer materials of this invention, these are merely intended as illustration of the present invention. Various other toners, carrier cores, substituents and processes such as those listed above may be substituted for those in examples with similar results.

Other modifications of the present invention will occur to those skilled in the art upon a reading of the present disclosure. These are intended to be included within the scope of this invention.

What is claimed is:

1. A magnetically-responsive electrostatographic carrier particle having an oxide coating, said carrier particle having been prepared by heat treating nickel particles in an ambient atmosphere at a temperature of between about 600° C. and about 1000° C. for between about 5 and about 10 minutes, said carrier particle having an average particle diameter of from between about 30 microns and about 1,000 microns, and wherein said carrier particle is further characterized as having semiconductive properties wherein the surface of said carrier particle has a volume resistivity of between about $10^6$ ohm-cm at about 300 volts and up to about $10^8$ ohm-cm at about 1,000 volts.

2. A magnetically-responsive electrostatographic carrier particle in accordance with claim 1 wherein said oxide coating is present in a thickness at least sufficient to form a thin continuous film on said particle.

3. A magnetically-responsive electrostatographic carrier particle in accordance with claim 1 wherein said oxide coating is present in an amount of from about 0.4 percent to about 4 percent by weight based on the weight of said particle.

4. An electrostatographic developer mixture comprising finely-divided toner particles electrostatically clinging to the surface of magnetically-responsive carrier particles having an oxide coating, said carrier particles having been prepared by heat treating nickel particles in an ambient atmosphere at a temperature of between about 600° C. and about 1,000° C. for between about 5 minutes and about 10 minutes, said carrier particles having an average particle diameter of from between about 30 microns and about 1,000 microns, and wherein said carrier particles are characterized as having semiconductive properties wherein the surface of said carrier particles has a volume resistivity of between about $10^6$ ohm-cm at about 300 volts and up to about $10^8$ ohm-cm at about 1,000 volts, said carrier particles being further characterized as providing developed electrostatographic images having lower background densities and higher resolution than untreated nickel carrier particles.

5. An electrostatographic developer mixture in accordance with claim 4 wherein said oxide coating is present in a thickness at least sufficient to form a thin continuous film on said carrier particles.

6. An electrostatographic developer mixture in accordance with claim 4 wherein said oxide coating is present in an amount of from about 0.4 percent to about 4 percent by weight based on the weight of said carrier particles.

7. An electrostatographic imaging process comprising the steps of providing an electrostatographic imaging member having a recording surface, forming an electrostatic latent image on said recording surface, and contacting said electrostatic latent image with a developer mixture comprising finely-divided toner particles electrostatically clinging to the surface of magnetically-responsive carrier particles having an oxide coating, said carrier particles having been prepared by heat treating nickel particles in an ambient atmosphere at a temperature of between about 600° C. and about 1000° C. for between about 5 minutes and about 10 minutes, said carrier particles having an average particle diameter of from between about 30 microns and about 1,000 microns, and wherein said carrier particles are characterized as having semiconductive properties wherein the surface of said carrier particles has a volume resistivity of between about $10^6$ ohm-cm at about 300 volts and up to about $10^8$ ohm-cm at about 1,000 volts, said carrier particles being further characterized as providing developed electrostatographic images having lower background densities and higher resolution than untreated nickel carrier particles, whereby at least a portion of said finely-divided toner particles are attracted to and deposited on said recording surface in conformance with said electrostatic latent image.

8. An electrostatographic imaging process in accordance with claim 7 wherein said oxide coating is present in a thickness at least sufficient to form a thin continuous film on said carrier particles.

9. An electrostatographic imaging process in accordance with claim 7 wherein said oxide coating is present in an amount of from about 0.4 percent to about 4 percent by weight based on the weight of said carrier particles.

10. A process for preparing magnetically-responsive electrostatographic carrier particles having an oxide coating, said process comprising heat treating nickel particles in an ambient atmosphere at a temperature of between about 600° C. and about 1000° C. for between about 5 and about 10 minutes, said carrier particles having an average particle diameter of from between about 30 microns and about 1,000 microns, and said carrier particles are characterized as having semiconductive properties wherein the surface of said carrier particles has a volume resistivity of between about $10^6$ ohm-cm at about 300 volts and up to about $10^8$ ohm-cm at about 1,000 volts.

11. A process for preparing magnetically-responsive electrostatographic carrier particles in accordance with claim 10 wherein said oxide coating is present in a thickness at least sufficient to form a thin continuous film on said particles.

12. A process for preparing magnetically-responsive electrostatographic carrier particles in accordance with claim 10 wherein said oxide coating is present in an amount of from about 0.4 percent to about 4 percent by weight based on the weight of said particles.

* * * * *